United States Patent [19]

Schmidt

[11] 4,393,557

[45] Jul. 19, 1983

[54] SAFETY BELT BUCKLE

[75] Inventor: Yves Schmidt, Audincourt, France

[73] Assignee: Aciers et Outillage Peugeot, Audincourt, France

[21] Appl. No.: 263,383

[22] Filed: May 13, 1981

[30] Foreign Application Priority Data

May 14, 1980 [FR] France ..... 80 10826

[51] Int. Cl.[3] ..... A44B 11/25

[52] U.S. Cl. ..... 24/230 A

[58] Field of Search ..... 24/230 A, 230 AL, 230 AP

[56] References Cited

U.S. PATENT DOCUMENTS 4,182,008 1/1980 Pouget ..... 24/230 A

*Primary Examiner*—Hugh R. Chamblee

*Attorney, Agent, or Firm*—Sughrue, Mion, Zinn, Macpeak and Seas

[57] ABSTRACT

In this buckle, a locking device retaining a latch attached to the belt comprises a tab which defines an abutment surface. The latter is adapted to cooperate with a complementary abutment surface of a support of the buckle when a tensile force is exerted on the belt which exceeds a predetermined value. The contact between the two abutment surfaces is opposed by the elastic deformation of certain parts of the buckle and in particular of a pivot pin of the locking device. The latter is maintained in position by spacer members provided between branches of the support and the locking device.

5 Claims, 4 Drawing Figures

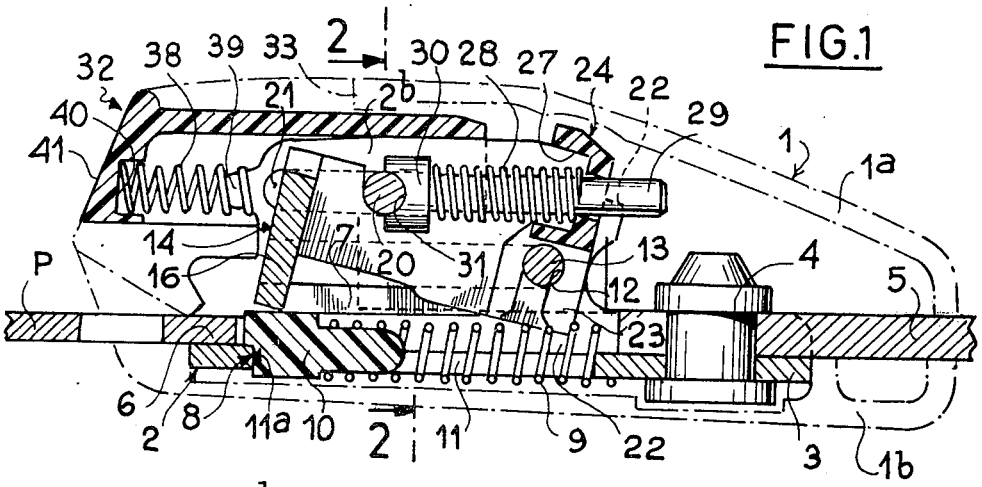
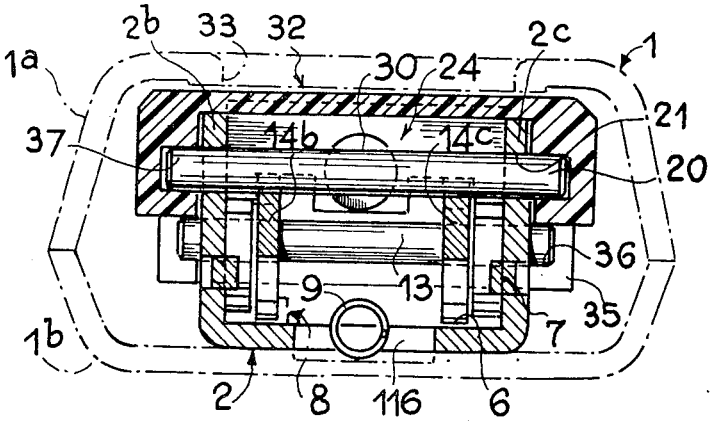
FIG.2
FIG.3
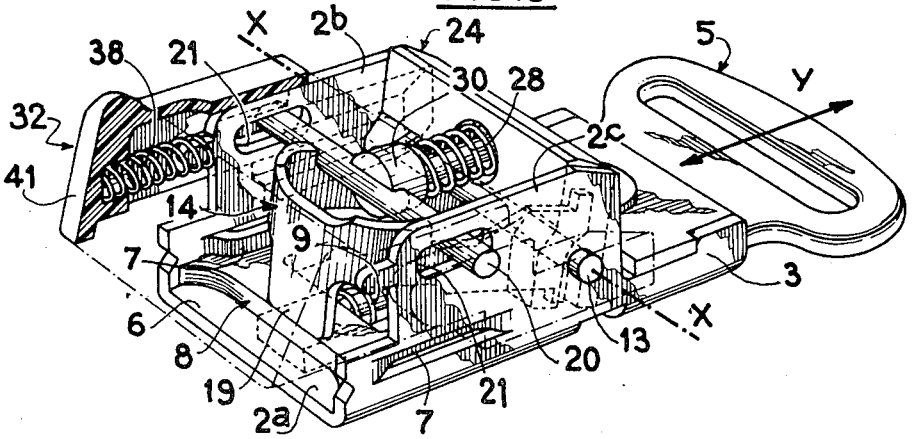

SAFETY BELT BUCKLE

DESCRIPTION

The present invention relates to a safety belt buckle adapted to attach a portion of the latter to retaining means through a tongue member constituting a latch fixed to the portion of the belt to be attached. The mechanism of this buckle is disposed in a case and comprises a support adapted to be fixed to the retaining means and in which is pivotable a locking means which retains the latch in the locked position of the buckle. This locking means also comprises a second abutment surface which is capable of bearing against a stop means which is movably mounted in the support and withdrawable by means of a control knob. When the latch engaged in such a buckle is subjected to a tensile force tending to extract the latch from the buckle, the locking means is subjected to a tilting moment about its pivot axis in the support which is prevented from happening by the stop means in the locked position of the buckle.

Such a buckle is described in U.S. Pat. No. 4,182,008.

One of the improvements described in this patent consists in providing on the locking means a third abutment surface which is adapted to cooperate with a complementary abutment surface formed in the support, the locking means being capable of slightly moving in translation in the support in the direction of movement of the latch. However, this movement is opposed by an elastically yieldable means which mainly acts on the pin on which the locking means pivots in the support.

This arrangement has the advantage of providing an additional retaining force when, upon impact, a force exceeding a threshold value is exerted on the latch in the extracting direction, the part of the locking means having the third abutment surface being then subjected to shear stresses which render the buckle much more effective at the very moment when its action is of prime importance. Further, in normal use of the buckle and more particularly in the course of the opening thereof, the third abutment surface is not operative since, under these conditions, the elastically yieldable means bias the lock member toward its normal rear position and thus separate this third abutment surface from the complementary abutment surface provided on the support.

From the point of view of the operation of the buckle, this arrangement is particularly advantageous, but it must however be mentioned that the presence of the elastically yieldable means complicates the construction of the buckle and renders its assembly time longer. This buckle is consequently not as cheap to make as would be desirable.

An object of the present invention is to provide a buckle which has the advantages of the presence of an auxiliary abutment surface which acts, in the case of impact, on the support and yet does not have special elastically yieldable means so that this buckle is simpler and may be produced at lower cost.

According to the invention, there is provided a safety belt buckle adapted to attach a portion of the belt to retaining means through a tongue member forming a latch, said buckle comprising a case in which is disposed a support adapted to be fixed to the retaining means, means for locking the latch which is pivotally mounted on the support to pivot about an axis defined by at least one articulation element, the locking means having a first abutment surface against which the latch is retained in the locked position, a second abutment surface adapted to bear against stop means which is movably mounted in the support and is withdrawable by means of a control knob so as to release the locking means, and a third abutment surface adapted to bear, in the locked position of the buckle, against a complementary abutment surface formed on the support, when a tensile force exceeding a predetermined value is exerted on the latch in the direction for extracting the latch, wherein the articulation element or elements by means of which the locking means are pivotally mounted on the support, project from each side of said locking means a predetermined distance, and spacer means are provided for maintaining the lateral position of the locking means with respect to the pivot axis thereof.

As a result of these features, when a tensile force exceeding a predetermined value is exerted on the belt and the latch in a direction which tends to extract the latch from the buckle, the third abutment surface bears against the complementary abutment surface of the support in opposition to a return action created by the elastic deformation of certain regions of the locking means and also of the articulation element or elements whereby the locking means are pivotally mounted on the support. Such an arrangement markedly simplifies the construction of the buckle since the elastically yieldable plate which was provided in the buckle disclosed in U.S. Pat. No. 4,182,008 may be dispensed with.

Further features and advantages of the invention will be apparent from the ensuing description which is given solely by way of example with reference to the accompanying drawings in which:

FIG. 1 is a sectional and elevational view of a buckle for a safety belt according to the invention;

FIG. 2 is a sectional view taken on line 2—2 of the buckle of FIG. 1;

FIG. 3 is a perspective view, with a part cut away, of the buckle according to the invention, the case thereof having been removed.

Figure 4:
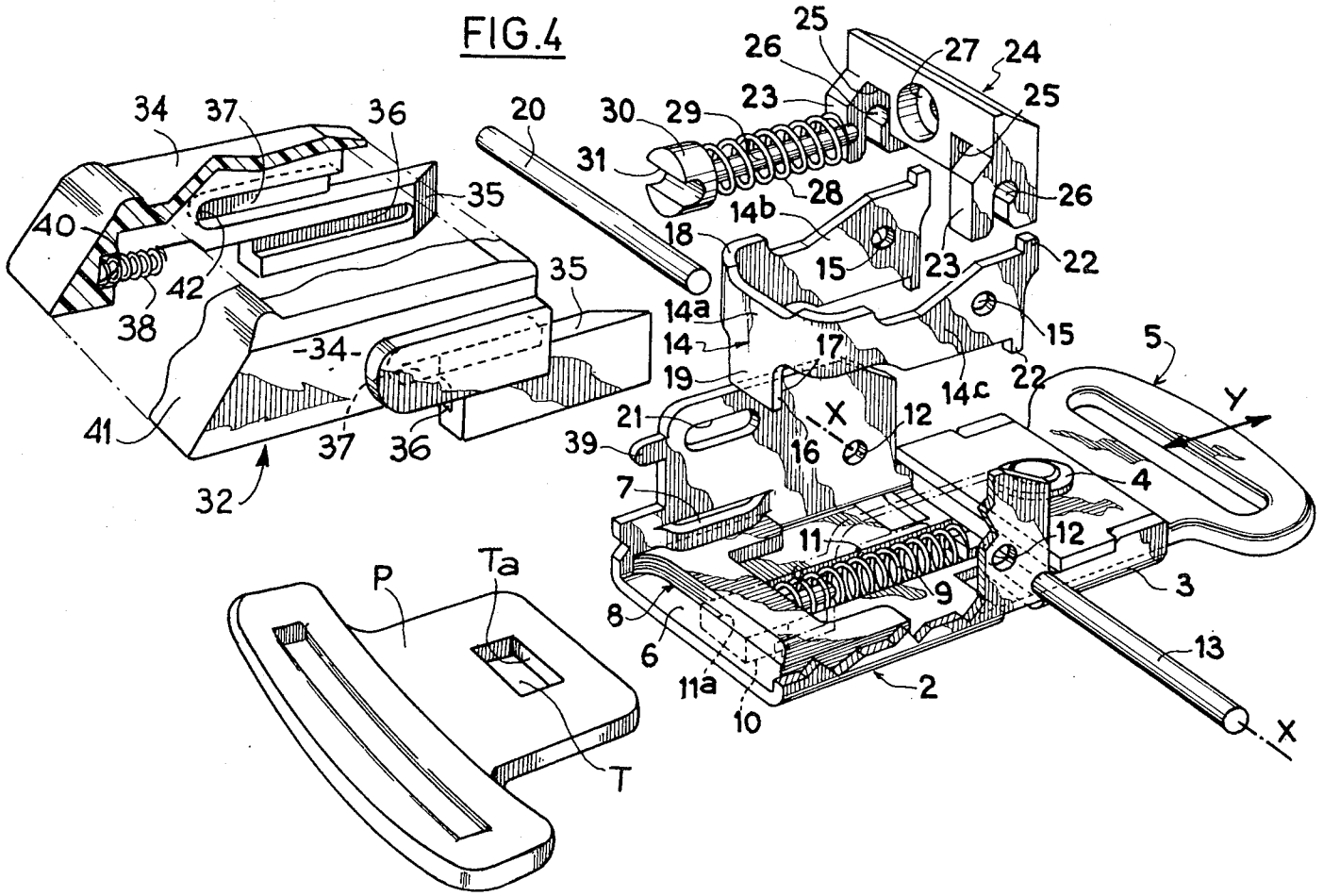
FIG. 4 is an exploded perspective view of the buckle according to the invention.

According to the embodiment shown in the drawings, the buckle according to the invention is disposed in a case 1 in two parts 1*a* and 1*b*, for example of moulded plastics material, these parts being united by welding along their joint plane. This case is provided solely for enclosing the mechanical part of the buckle and does not participate in the operation of the latter.

A support 2 having a U-shape comprises a web 2*a* and two branches or walls 2*b* and 2*c*, the web extending rearwardly so as to form a fixing portion 3 through which a rivet 4 extends which is adapted to secure the buckle to retaining means 5. In the illustrated embodiment, these retaining means comprise in particular a keeper in which is sewn a portion (not shown) of the safety belt.

The support 2 defines a sliding passage 6 which extends in a direction parallel to the web 2*a* rearwardly of the buckle and is defined in particular by two projections 7 formed in the branches 2*b* and 2*c*. Note that these projections formed by a press operation have a relatively long extent for a purpose which will be explained hereinafter.

A slide 8, preferably formed from plastics material, is disposed in the passage 6 so as to be movable in translation in opposition to the action of a spring 9 termed an "ejection" spring which bears against the rear part 3 of the support 2, the slide 8 being guided by a projecting portion 10 in a longitudinal aperture 11 formed in the web of the support.

The leading edge of the slide 8 is so shaped as to adapt itself to the leading edge of a latch P which is attached to the other portion of the safety belt and which must consequently be attached to the retaining means 5 when the buckle is used in the locked position. As can be seen in particular in FIGS. 1 and 4, the latch P comprises a tongue member adapted to be inserted in the buckle and having a rectangular aperture T, its width corresponding, apart from clearance, to the distance between the branches 2*b*, 2*c* of the support 2.

These branches 2*b* and 2*c* are provided with apertures 12 through which a pivot pin 13 extends. This pin is an element which ensures the articulation or pivotal connection to the support of locking means 14 for pivotal movement about an axis X—X which extends in a direction parallel to the passage 6 and transversely of the direction of insertion of the latch P into the buckle (direction indicated by arrow Y).

The locking means 14 preferably comprise a blanked and folded sheet metal member having substantially the shape of a U whose web 14*a* is located in front and whose branches 14*b* and 14*c* extend rearwardly and are provided with apertures 15 through which the pin 13 extends. The web 14*a* of these locking means comprises a tab 16 which extends in the direction of the passage 6 and defines a first abutment surface 17 in confronting relation to the rear part 3 of the support 2. In the portions connecting the web 14*a* to the respective branches 14*b* and 14*c*, the locking means 14 also have a second abutment surface 18 (thus two surface portions are provided) and the tab 14 defines on the forwardly facing side thereof a third abutment surface 19.

The first abutment surface 17 is adapted to cooperate with the operative edge Ta of the aperture T provided in the latch P. The second abutment surface 18 is adapted to cooperate with a stop pin 20 which is disposed transversely in the support and extends through oblong openings 21 formed in the branches 2*b* and 2*c* of the support 2. The third abutment surface 19 is adapted to cooperate with the front edge 11*a* of the aperture 11 formed in the web 2*a* of this support.

The branches 14*b* and 14*c* have, at the ends thereof remote from the web 14*a*, retaining tabs 22 which extend upwardly and downwardly respectively.

FIG. 2 clearly shows that the pin 13 which constitutes the articulation element pivotally mounting the locking means 14 on the support 2, extends on each side of the locking means a predetermined distance before extending through the apertures 12 formed in the branches of the support 2. The two gaps thus formed between the locking means and the support 2 are filled by spacer members 23 of a mounting member 24 preferably of plastics material and placed between the rear parts of the branches 2*a* and 2*b*. The mounting member 24 straddles the rear part of the branches 14*b* and 14*c* of the locking means, these branches being engaged in recesses 25 formed on each side of this mounting member. The spacer members 23 also have notches having a rounded inner end and adapted to engage, by an elastic clipping action, on the pin 13, it being understood that when the mounting member is placed in position in the buckle, it bears by the rear face thereof against the retaining tabs 22 of the locking means 14.

The mounting member 24 also has a transverse aperture which extends in the longitudinal direction of the support (direction Y) and which is stepped in such manner as to define a shoulder 27 for a return spring 28 for the stop pin 20. The spring 28 is mounted on a rod 29 which terminates in the front in a knob 30 in which is formed a groove 31 so that this knob can be placed on the stop pin 20 by an elastic clipping action and rendered unitary with this pin. The pin 29 extends in the direction Y when the buckle is assembled.

An actuating knob 32 is slidably mounted on the support 2. This knob is preferably made from plastics material and projects from the case 1 through an aperture 33 formed in the upper part 1*a* of this case. It comprises a body 34 from which lateral lugs 35 extend. Each of these lugs 35 has on the inwardly facing side thereof two grooves 36 and 37 in which are respectively engaged the end portions of the pin 13 extending beyond the branches 2*b* and 2*c* and the end portions of the stop pin 20 extending also beyond these branches.

Two return springs 38 are respectively engaged on maintaining tabs 39 provided on the front edge of the branches 2*b* and 2*c* and these springs are received in blind apertures 40 formed inside the front wall 41 of the knob 32.

The grooves 37 of the knob 32 define at their front ends abutments 42 which are adapted to come in contact with the end portions of the pin 20 so that, when the knob 32 is urged rearwardly, the pin 20 is also urged rearwardly and brought to its withdrawn position corresponding to the opening of the buckle.

The buckle just described operates in the following manner:

FIGS. 1 and 2 show the buckle closed and FIG. 3 shows the buckle in the open position, i.e. when the latch P is withdrawn. With reference first of all to FIG. 3, it can be seen that when the latch is inserted in the buckle, the former urges the slide 8 rearwardly by compressing the ejection spring 9. When the operative edge Ta of the aperture T in the latch P reaches the position of the tab 16 of the locking means 14, the latter can start its movement of rotation about the axis X—X, it being made to effect this movement by the action exerted by the slide 8 on the spacer members 23 of the mounting member 24. The presence of these spacer members is consequently advantageously taken advantage of for this purpose.

When the locking means have completed their movement of rotation, the abutment surfaces 18 are placed under the locking pin 20 so that the latter can move in translation in the forward direction, it being biased in this direction by the spring 28. When the pin 20 reaches the extreme forward position thereof, the buckle is locked and the latch can no longer be extracted. Note that during the closure of the buckle, the actuating knob 32 remains in position and consequently does not have to be shifted.

If the assembly is subjected to a tensile force exceeding a given value, this force being exerted in the direction of arrow F (FIG. 1) and which can occur when a passenger retained by the belt is projected forwardly upon impact on the vehicle equipped with the buckle, the force F is transmitted to the tab 16 of the locking means by the edge Ta of the latch P. Under these conditions, the lock is urged forwardly and is retained by the pin 13 which transmits the force through the support 2 to the retaining means 5.

As the branches 14*b* and 14*c* of the locking means are pivoted to the pin 13 at a given distance from the branches 2*b* and 2*c* of the support 2 and from the "bearings" formed by the apertures 12, each of these branches exerts a deforming moment on the portions of the pin 13 extending beyond the locking means so that this pin can elastically deform. The same is true of the tab 16, so that, if the force F is sufficient, the front face of the tab 16 (third abutment surface 19) comes in contact with the edge 11*a* of the aperture 11 in the web 2*a* of the support 2. Consequently, the locking means are additionally also retained by the web of the support so that the effectiveness of the locking of the latch P is very markedly reinforced. Consequently, the elements of the buckle may be dimensioned to have smaller thicknesses and diameters than in the prior art. Note that, in the locked position of the buckle, the gap normally existing between the third abutment surface 19 and the front edge 11*a* of the aperture 11 is very small and that the elastic deformation mentioned hereinbefore is just sufficient for taking up this gap.

By way of example, in a buckle produced by the Applicant, there was chosen for the pin 13 a diameter of 4 mm and the pin was made from steel of the type FM66 which had been hardened and tempered for a strength of 120 to 150 daN/mm$^2$. The locking means 13 were made from steel of the type M55-1, the thickness of the metal being 2 mm and the whole of this part was hardened and tempered after forming in order to obtain a strength of 120 to 150 daN/mm$^2$. Under these conditions, a force exceeding 50 kg exerted on the latch P was sufficient to take up the aforementioned clearance or gap.

In order to open the buckle, the knob 32 is shifted rearwardly so as to return the stop pin 20 rearwardly in opposition to the action of the spring 28. The rod 29 slides in the aperture formed in the mounting member 24. As the pin reaches the end of its travel in the openings 21, the locking means are released and can swing upwardly and unlock the latch, the tab 16 being withdrawn from the passage 6.

The arrangement described hereinbefore of course results in the same advantages as those resulting from the construction of the buckles described in U.S. Pat. No. 4,182,008, namely the force which must be exerted by the user on the knob 32 is comparatively small relative to that required in conventional buckles.

A modification of the mechanism described hereinbefore consists in providing locking means comprising, in one piece therewith, articulation elements which extend on each side upwardly and are rotatably mounted in the branches of the support.

Note that the guiding of the latch P in the passage 6 is particularly effective bearing in mind the arrangement and the great width of the projections 7. Owing to this feature of the buckle, the latter is easy to open even if, upon actuation of the knob 32, the belt exerts on the latch a considerable force which is oblique with respect to the orientation of the passage 6 in the longitudinal plane of symmetry of the buckle. An obliqueness of up to 30° does not hinder this opening.

Having now described my invention what I claim as new and desire to secure by Letters Patent is:

1. In a safety belt buckle for attaching a portion of a safety belt to retaining means through a tongue member constituting a latch, said buckle comprising a case, a support for fixing to the retaining means and disposed in the case, the support having two spaced-apart walls, locking means for the latch, the locking means being disposed between said walls, articulation means mounting the locking means on said walls of the support so that the locking means are pivotable on said walls of the support about an axis, stop means movably mounted on the support, the locking means defining a first abutment surface cooperative with the latch to retain the latch in a locked position, the locking means defining a second abutment surface adapted to bear against the stop means, a control knob cooperative with the stop means for withdrawing the stop means and releasing the locking means, the support defining a complementary abutment surface, the locking means defining a third abutment surface adapted to be applied, in a locked position of the buckle, against said complementary abutment surface when a tensile force exceeding a predetermined value is exerted on the latch in a direction for extracting the latch; the improvement wherein said locking means define a predetermined space therebetween and each of said walls of the support, said articulation means project from opposite sides of the locking means and extend through said spaces and into said walls of the support whereby a force for shifting the locking means relative to said walls of the support in a direction perpendicular to said axis would elastically deform said articulation means on opposite sides of the locking means, spacer means being provided for maintaining said spaces between the locking means and said walls of the support so that, when said tensile force is exerted, said third abutment surface and said complementary abutment surface come in contact with each other by elastic deformation of said articulation means.

2. A buckle according to claim 1, wherein said support has a U-shape and comprises branches constituting said two walls of the support, said articulation means comprising a pivot pin which extends through said branches, a mounting member defining said spacer means and comprising two spacer members respectively disposed in said two spaces on opposite sides of the locking means and against said branches of the support.

3. A buckle according to claim 2, wherein each spacer member defines a notch in which said pivot pin is engaged and by means of which notches the pivot pin is rendered unitary with the mounting member by an elastic clipping action therebetween.

4. A buckle according to claim 2 or 3, wherein the locking means have a U-shape and comprise a web and branches, which latter branches are pivotally mounted on said pivot pin, said web of the locking means defining said first and third abutment surfaces, said mounting member straddling free end portions of said branches of the locking means.

5. A buckle according to claim 2 or 3, wherein said support defines a guide passage, in which passage the latch is engaged when locking, said guide passage being defined by elongated projections formed in said lateral branches of the support.

* * * * *